US007156236B2

(12) United States Patent
Geraghty

(10) Patent No.: US 7,156,236 B2
(45) Date of Patent: Jan. 2, 2007

(54) MACHINE FOR REMOVING ARTICLES DEPOSITED ON THE GROUND

(75) Inventor: William F. Geraghty, Cumberland, MD (US)

(73) Assignee: Rockland, Inc., Bedford, PA (US)

( * ) Notice: Subject to any disclaimer, the term of this patent is extended or adjusted under 35 U.S.C. 154(b) by 41 days.

(21) Appl. No.: 10/786,291

(22) Filed: Feb. 26, 2004

(65) Prior Publication Data

US 2005/0189273 A1 Sep. 1, 2005

(51) Int. Cl.
*B07B 1/49* (2006.01)

(52) U.S. Cl. ..... 209/421; 209/616; 209/625; 209/632; 171/63; 171/65; 171/89

(58) Field of Classification Search ..... 171/63, 171/65, 84, 25, 18, 89; 209/421, 616, 625, 209/632; 198/693, 697, 699.1
See application file for complete search history.

(56) References Cited

U.S. PATENT DOCUMENTS

| | | | | |
|---|---|---|---|---|
| 887,015 | A | 5/1908 | Pippen | |
| 972,910 | A | 10/1910 | Pippen | |
| 1,085,162 | A | 1/1914 | Rose | |
| 2,110,997 | A | 3/1938 | Mayfield | |
| 2,976,936 | A * | 3/1961 | Fry | 171/126 |
| 3,024,903 | A * | 3/1962 | Jamal | 209/632 |
| 3,316,977 | A | 5/1967 | Snook | |
| 3,362,480 | A * | 1/1968 | Barber | 171/89 |
| 3,807,154 | A | 4/1974 | Moore | |
| 4,014,390 | A | 3/1977 | Teixeira | |
| 4,050,518 | A | 9/1977 | Gilmour | |
| 4,056,205 | A * | 11/1977 | Etzler, IV | 414/722 |
| 4,121,667 | A | 10/1978 | Curl | |
| 4,241,792 | A | 12/1980 | Kratzer | |
| 4,482,019 | A | 11/1984 | Murphy | |
| 4,608,725 | A * | 9/1986 | Jackson | 15/3 |
| 5,133,413 | A * | 7/1992 | Baxter | 171/63 |
| 5,160,034 | A | 11/1992 | Potter | |
| 5,184,916 | A | 2/1993 | Thoer | |
| 5,197,211 | A | 3/1993 | Haug | |
| 5,220,965 | A | 6/1993 | Haug | |
| 6,094,847 | A | 8/2000 | Gallenberg | |
| 6,351,898 | B1 | 3/2002 | Lewis | |
| 2002/0040790 | A1 | 4/2002 | Ohzeki et al. | |
| 2002/0040791 | A1 | 4/2002 | Ohzeki et al. | |
| 2002/0040792 | A1 | 4/2002 | Ohzeki et al. | |
| 2002/0040793 | A1 | 4/2002 | Ohzeki et al. | |
| 2002/0040794 | A1 | 4/2002 | Ohzeki et al. | |
| 2002/0040796 | A1 | 4/2002 | Ohzeki et al. | |

* cited by examiner

*Primary Examiner*—Kathy Matecki
*Assistant Examiner*—Terrell Matthews
(74) *Attorney, Agent, or Firm*—Stevens, Davis, Miller & Mosher, LLP

(57) ABSTRACT

A machine for removing articles such as debris and the like deposited on a tract of ground, comprising a wheel unit; a support frame mounted on said wheel unit, having means for advancing said machine along said tract of ground; a endless conveyor mounted on said support frame, having a plurality of tines projecting from an outer side thereof and a flight extending from a front end adjacent ground level, upwardly and inwardly to an elevated rear end; a receptacle mounted on said support frame, positioned to receive articles removed by said tines and carried upwardly and rearwardly on said conveyor and discharged into said receptacle, and having a set of tines cooperable with said conveyor tines to dislodge articles carried by said conveyor tines; and means mounted on said support frame for driving said conveyor.

20 Claims, 3 Drawing Sheets

MACHINE FOR REMOVING ARTICLES DEPOSITED ON THE GROUND

This invention relates to a machine for gathering articles deposited on the ground and more particularly to a machine suitable for removing debris strown on sandy tracts of ground such as beaches. The invention further contemplates a machine suitable for use in removing debris from tracts of sandy ground in which the debris is effectively removed from the sand and collected and any sand removed in such process is returned to the ground.

BACKGROUND OF THE INVENTION

In the prior art, a number of machines have been developed for removing debris from the ground and particularly machines for removing debris strown on sandy beaches. Typically, such machines have been towed by a tractor, and have included an endless conveyor extending upwardly and rearwardly, means for directing debris and some accompanying sandy earth onto an upper, forwardly disposed flight of the conveyor, and a receptacle for receiving debris carried by the conveyor and discharged at an upper, rearward end thereof. Although such machines have been effective in removing and collecting such debris, they have been found not to be entirely effective in separating the debris from the sand, returning the sand to the ground and totally capturing the debris in a receptacle for removal to a suitable dump site. Accordingly, it is the principal object of the present invention to provide a machine of the type described which is operable to effectively and efficiently gather debris from the ground, separate such debris from any earth gathered by the removal mechanism of the machine, return the earth particles to the ground and capture the debris in a receptacle for delivery to a suitable dump site.

SUMMARY OF THE INVENTION

The principal object of the present invention is achieved by providing a machine generally consisting of a wheel unit; a support frame mounted on the support wheel, having means for advancing the machine along the ground; an endless conveyor mounted on the support frame, having a plurality of tines projecting from an outer side thereof, and a flight extending from a front end thereof adjacent ground level, upwardly and rearwardly to an elevated rear end; a receptacle mounted on the support frame, positioned to receive debris engaged by such conveyor tines and carried upwardly and rearwardly on such conveyor and discharged into the receptacle, and having a set of tines cooperable with the conveyor tines to disengage debris engaged by the conveyor tines; and means mounted on the support frame for driving the conveyor.

DETAIL DESCRIPTION OF THE PREFERRED EMBODIMENT

Figures 1, 2:
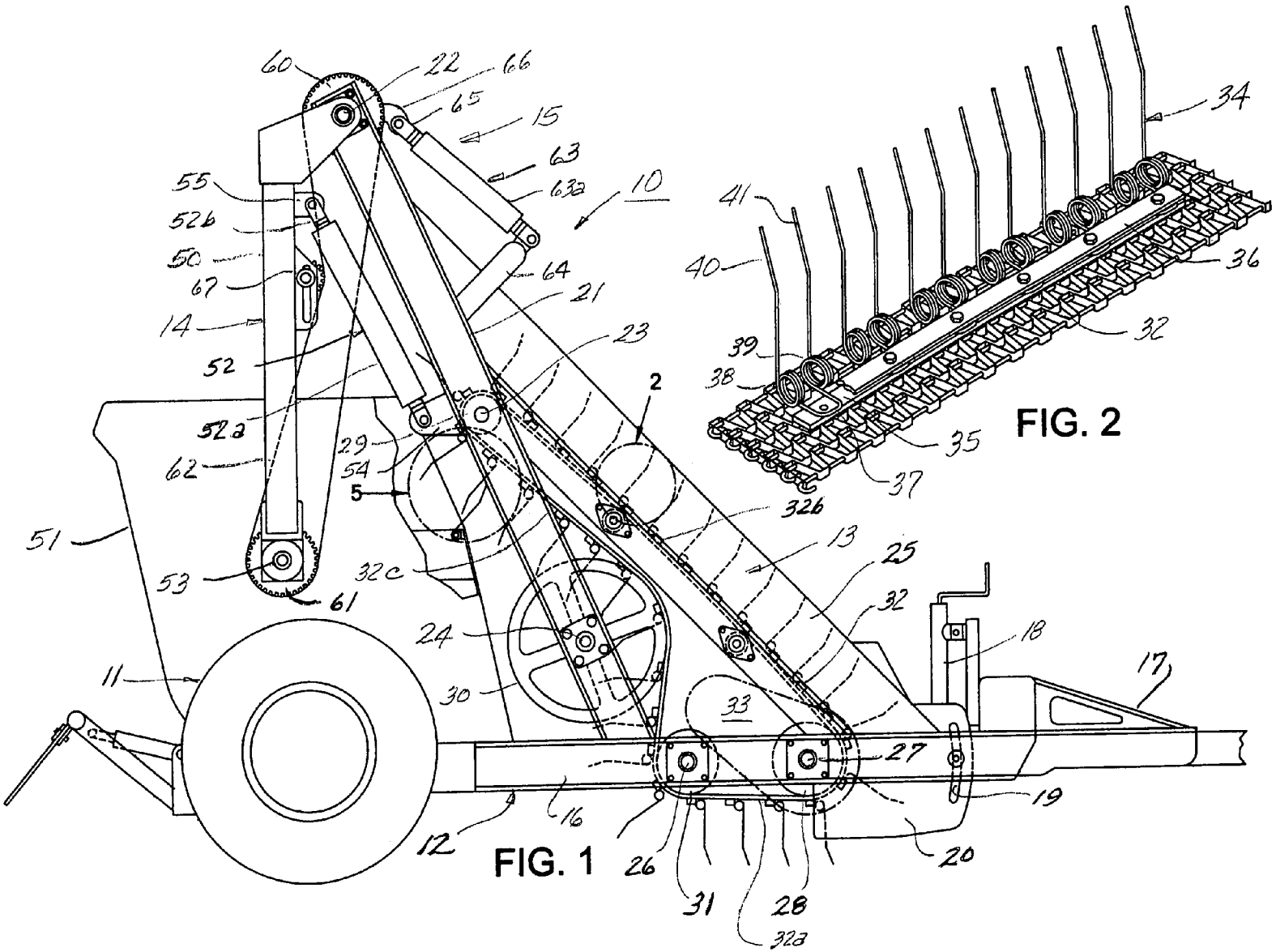
FIG. 1 is a side elevational view of a machine embodying the present invention.
FIG. 2 is an enlarged, perspective view of that portion of the conveyor of the machine designated by the reference numeral 2 in FIG. 1.

Referring to the drawings, there is illustrated a machine 10 for removing debris from a tract of sandy ground such as a beach, generally including a wheel unit 11, a support frame 12 mounted on the wheel unit, a conveyor belt assembly 13 mounted on the support frame, a bucket assembly 14 mounted on the rear end of the support frame and cooperable with the conveyor assembly, and bucket tilt assembly 15 mounted on the support frame and cooperable with the bucket assembly. Wheel unit 11 is of a conventional construction including an axle and a pair of wheels. Support frame assembly 12 is supported on the axle of the wheel unit and includes a pair of longitudinal disposed, transversely spaced beams 16, 16 and a set of interconnecting cross beams (not shown). A drawbar 17 is pivotally connected to the front end thereof, which may be detachably connected to a tractor or other prime mover means for towing the machine. The angular relationship of the drawbar to the support frame assembly may be adjusted by means of a mechanism 18 which is adapted to angularly displace the drawbar relative to the support frame about an axis of a pair of curved slots 19, 19 formed in a pair of lower, transversely spaced side walls 20, 20. Mounted on beam members 16, 16 adjacent the rear ends thereof and extending upwardly and rearwardly is a pair of support beams 21, 21 interconnected by cross beams (not shown) and having a transversely disposed shaft 22 journaled in the upper ends thereof and a pair of transversely disposed shafts 23 and 24 journaled intermediate shaft 22 and the lower ends of beam members 21, 21. Also supported at the upper ends of beam members 21, 21 and at the lower ends thereof is a pair of rearwardly and upwardly extending, transversely spaced side walls 25, 25. In addition, a pair of longitudinally spaced, transversely disposed shafts 26 and 27 are journaled in beam members 16, 16.

Conveyor belt assembly 13 is best illustrated in FIGS. 1 and 2. It consists of an endless, conventional stainless steel conveyor belt 32 trained about drive sprockets 28, 28, idler sprockets 29, 29, idler wheels 30, 30 and idler sprockets 26, 26 to provide a lower, substantially horizontal flight 32*a*, an upwardly and rearwardly extending flight 32*b* between side walls 25, 25 and a lower, downwardly and forwardly extending flight 32*c*. The belt is driven by a hydraulic motor mounted on the support frame and drivingly connected to a sprocket 28 by means of a chain drive disposed within a housing 33. Conveyor belt 32 is of a chain link construction providing a plurality of openings therethrough. Mounted on the outer side of such belt is a plurality of longitudinally spaced, transversely disposed tine assemblies 34. As best shown in FIG. 2, each of such assemblies includes a base strip 35 and a retainer strip 36 secured to the belt and a plurality of tine units secured between strips 35 and 36, spaced along such strips and having portions projecting substantially perpendicular from belt 32 along belt flights 32*a*, 32*b* and 32*c*. Each of such tine units consists of a metal wire bent at the center thereof to form a U-shaped center portion 37, having the leg segments of such U-shaped portion contouring into spiraled, spring portions 38 and 39 and having the spiral spring portions continuing as free ends 40 and 41 disposed substantially tangentially to the spiraled spring portions 38 and 39. Each of base strips 35 is disposed on the inner side of conveyor belt 32, each of retainer strips 36 is mounted on the outer side of the conveyor belt in alignment with a base strip, each of the U-shaped portions of the tine units is interposed between the conveyor belt and a retainer strip 36 and the tine units are fixed in position as shown in FIG. 2 by a set of bolts 42 extending through openings in each retainer strip and openings in the conveyor belts and threaded into a base strip.

Figure 3:
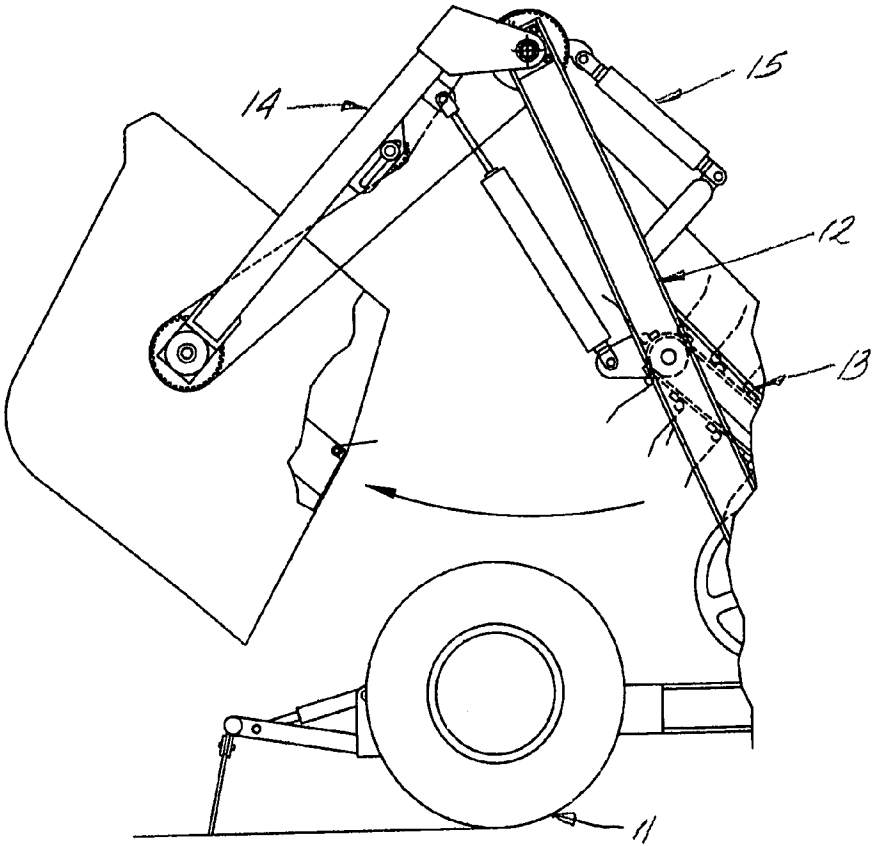
FIG. 3 is a partial side elevational view of the machine shown in FIG. 1, illustrating the bucket portion thereof being lifted.

Bucket assembly 14 generally consists of a pair of transversely spaced lift arms 50, 50, a bucket 51 pivotally connected to the lower ends of the lift arms and a pair of hydraulic cylinder assemblies 52, 52 each operatively interconnecting a beam member 21 and a lift arm 50. Lift arms 50, 50 are pivotally connected at their upper ends to shaft 22. Bucket 51 is provided with a pair of trunnions 53, 53 mounted on the side walls thereof to which the lower ends of left arms 50, 50 are pivotally connected. Each of cylinder assemblies 52 includes a cylinder member 52*a* pivotally connected at a base end thereof to a bracket 54 mounted on a rearward side of a beam member 21, and a rod member 52*b* pivotally connected to a bracket 55 mounted on the front side of a lift arm 50. It will be appreciated that by supplying fluid under pressure to the base or rod ends of cylinder assembly 52, the bucket may be lifted and lowered as illustrated in FIG. 3.

Figure 4:
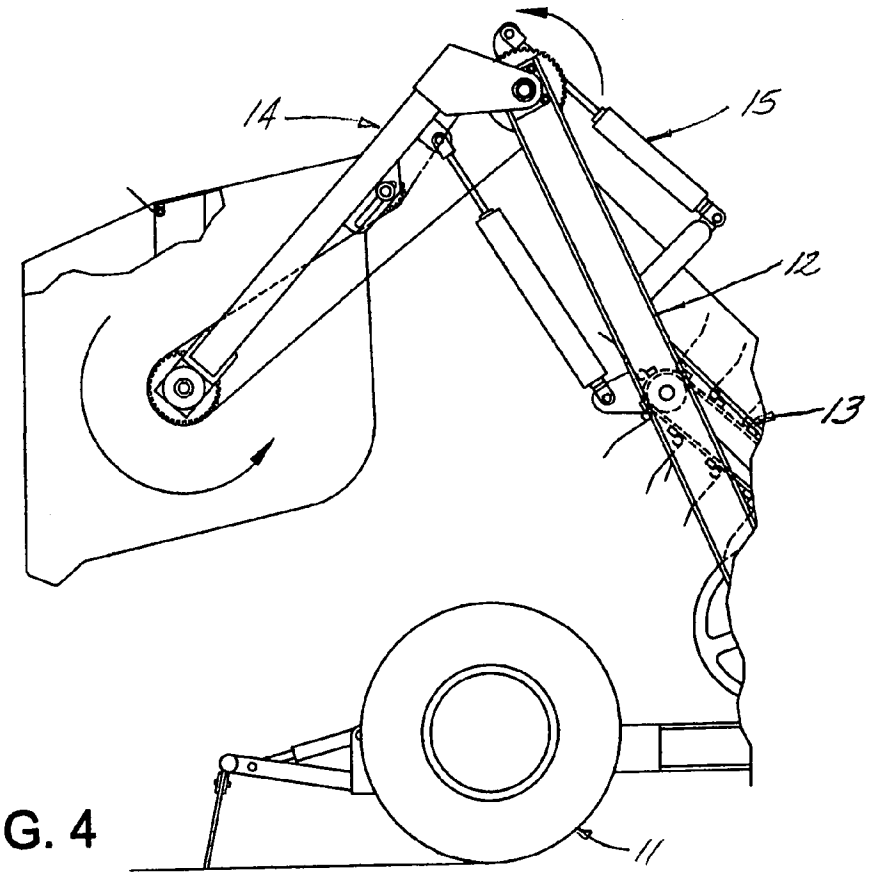
FIG. 4 is a view similar to the view shown in FIG. 3 illustrating the bucket in an elevated position and being tilted for dumping the contents thereof.

Tilt assembly 15 generally consists of a pair of sprockets 60, 60 rotatably mounted on shaft 22, a pair of sprockets 61, 61 rigidly mounted on trunnions 53, 53, a drive chains 62, 62 trained about sprockets 60 and 61 and a fluid actuated cylinder assemblies 63, 63 operatively interconnecting beam members 21, 21 and rotatable sprockets 60, 60. Each of cylinder assemblies 63, 63 includes a cylinder member 63*a* pivotally connected at its base end to a bracket 64 connected to a beam member 21 and a rod member 65 connected to an arm member 66 rigidly secured to a sprocket 60 substantially radially relative to the axis of shaft 22. It will be appreciated that when the bucket is in an elevated position as shown in FIG. 3, it may be tilted by supplying fluid under pressure to the base and rod ends of cylinder members 63*a*, 63*a*, as illustrated in FIG. 4. Slack in each of chains 62 may be taken up by a chain tension adjusting device mounted on lift arms 50, 50 and operatively engageable with flights of chain 62, 62.

Figure 5:
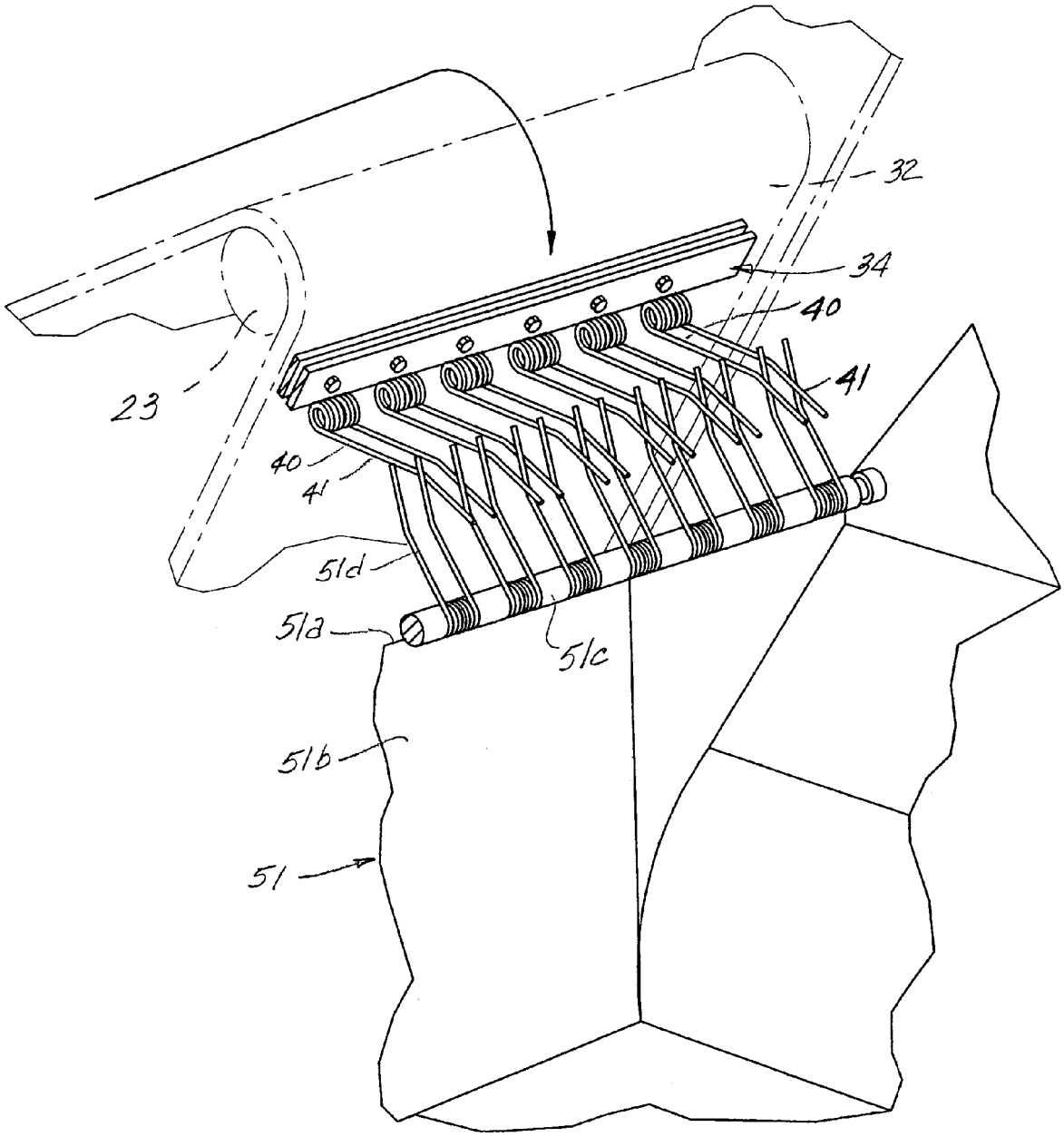
FIG. 5 is an enlarged, partial perspective view of that portion of the machine designated by the reference numeral 5 in FIG. 1, illustrating the manner of cooperation of the conveyor and bucket tines in disengaging articles carried by the conveyor tines.

Bucket 51 is provided with a pair of side walls, front and rear walls and a bottom wall providing an open upper end. When the bucket is in its lower position as shown in FIG. 1, the front end of the opening in the bucket is disposed below and adjacent the upper end of the conveyor belt assembly. As best shown in FIG. 5, the upper edge 51*a* of bucket front wall 51*b* is disposed below and rearwardly of shaft 23 of the conveyor belt assembly, and is provided with a transversely disposed rod 51*c* on which there is mounted a number of tine units 51*d* spaced along rod 51*c*. The leg portions of tine units 51*d* project substantially tangentially relative to rod 51*a* and project into the envelope defined by the outer ends of tine units 34 of the conveyor belt as they advance along their paths, substantially perpendicular to belt flight 32*c* as shown in FIG. 1.

Leg portions 40 and 41 of each tine unit 34 of the conveyor belt lie in the same substantially vertical planes as leg portions 40 and 41 of other tine units of the conveyor belt, offset transversely relative to the leg portions of tine units 51*d* so that as tine leg portions 40 and 41 of the conveyor belt sweep about the axis of shaft 22 and traverse along belt flight 32*c*, they will pass between the leg portions of tine units 51*d* as shown in FIG. 5.

In the use and operation of the machine as described, when the drawbar of the machine is attached to a tractor or other prime mover for use in cleaning a sandy beach, the crank of leveling mechanism 18 is operated to vary the angle between the drawbar and the support frame of the machine and correspondingly fix the positions of the ends of the leg portions of the tine units mounted on the conveyor belt along belt flight 32*a* relative to the ground. The ends of such leg portions thus may be positioned either above, at or just below ground level. With the frame height thus adjusted, the hydraulic motor for the conveyor belt assembly is operated and the tractor is moved ahead along the path of the tract to be cleaned. As the machine thus advances, the tine units along belt flight 32*a* will engage the sandy ground and debris deposited thereof and cause such debris and some of the sand with the debris to be picked up and conveyed upwardly and rearwardly along belt flight 32*b* of the conveyor assembly. As the debris and sand advances along such flight, the sand particles will be caused to fall through the openings in the conveyor belt and be deposited on the ground. The debris either engaged or impaled by the leg portions of the tine units will be carried to the upper end of flight 32 and then caused to traverse about a 180° arc and through lower belt flight 32*c*. As the belt travels about the upper end of the conveyor assembly, a certain portion of the debris carried by the belt will gravity fall into the bucket. As the leg portions of tine units 34 advance through belt flight 32*c*, debris clinging to the belt and perhaps impaled by the leg portions of the tine units will be caused to be dislodged as leg portions 40 and 41 of units 34 pass between the leg portions of tine units 51 and such dislodged portions of the debris also will be caused to gravity flow into the bucket thus wiping leg portions 40 and 41 free as they progress downwardly, free to engage and convey additional debris as they traverse belt flight 32*a*.

The extension of the leg portions of tine units 51*d* into the envelope defined by the paths traversed by the outer ends of leg portions 40 and 41 of units 34, the perpendicular positions of the leg portions of units 51*d* relative to belt flight 32*c*, the positioning of the leg portions of tine units 51*d* below and rearwardly of the axis of shaft 23 and the passage of leg portions 40 and 41 of tine units 34 between the leg portions of tine units 51*d*, assures the gravity discharge of loose debris on the conveyor belt into the bucket and the removal of lodged debris on the conveyor belt through the combing effect of the leg portions of tine units 51*d* as leg portions 40 and 41 of tine units 34 pass therebetween, permitting such dislodged debris to also gravity fall into the bucket.

The machine may be towed and operated in the manner described until the bucket is filled with debris and it is desired to dispose of such load. Under such circumstances, the operation of the conveyor belt is simply discontinued, the leveling mechanism may be operated to lift the front end of the support frame to facilitate travel and the machine may be towed to a suitable dump area. At the dump site, the debris may be discharged merely by operating lift cylinder assemblies 52, 52 to a position as shown in FIG. 3 and then operating dump cylinder assemblies 63, 63 to cause the bucket to tilt and thus allow the debris to gravity fall onto the ground. When the bucket has been emptied, cylinder assemblies 63, 63 and 52, 52 may be operated to return the bucket to the position as shown in FIG. 1. The machine would then be configured to return to the area for continuing the cleaning operation as described.

As previously mentioned, the wheel unit may be of a conventional, commercially available assembly. The support frame may be constructed of readily available steel stock, cut to suitable size and welded and/or bolted together. The shafts, sprockets and drive components of the belt conveyor assembly may consist of commercially available components. The conveyor belt may be of any commercially available construction although it is preferred that it be of a stainless steel material to withstand the corrosive and eroding effects of the material being handled. The tine units preferably are formed of spring steel wire in the configurations as described to allow flexure of the leg portions thereof when engaging the ground and obstacles in their path. The lift and dump cylinder assemblies also may be of commercially available assemblies.

It will be appreciated that the machine as described provides a comparatively simple design which is effective and efficient in gathering articles such as debris and the like deposited on a tract of ground, separating such articles from earth particles carried along with the articles, returning such earth particles to the ground and then cleanly removing the articles from the belt conveyor assembly and depositing them in a receptacle to be hauled and dumped at a suitable site.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

I claim:

1. A machine for removing articles such as debris and the like deposited on a tract of ground, comprising:

a wheel unit;

a support frame mounted on said wheel unit, having means for advancing said machine along said tract of ground;

a endless conveyor mounted on said support frame, having a plurality of tines projecting from an outer side thereof and a flight extending from a front end adjacent ground level, upwardly and rearwardly to an elevated rear end;

a receptacle mounted on said support frame, positioned to receive articles removed by said tines and carried upwardly and rearwardly on said conveyor and discharged into said receptacle, and having a set of tines mounted on a front, transverse wall thereof, cooperable with said conveyor tines to dislodge articles carried by said conveyor tines; and means mounted on said support frame for driving said conveyor.

2. A machine according to claim 1 wherein said means for advancing said machine comprises a drawbar connected to said support frame and connectable to a prime mover.

3. A machine according to claim 1 wherein said conveyor tines are spaced longitudinally and transversely along said conveyor.

4. A machine according to claim 1 wherein said conveyor tines are arranged in transversely disposed, longitudinally spaced rows.

5. A machine according to claim 1 wherein a pair of said conveyor tines are formed of a strand of wire bent at the center thereof to form a U-shaped center portion, having each of the leg segments of said U-shaped portion contoured into a spiral, spring portion and having each of said spiral, spring portion continuing as a free end disposed substantially tangentially relative to said spiral, spring portion.

6. A machine according to claim 5 including a plurality of base strips transversely disposed and longitudinally spaced on and rigidly secured to said conveyor, and a plurality of retainer strips each mounted on said conveyor in alignment with one of said base strips and wherein the U-shaped portions of said tines are seated on an outer side of said conveyor, interposed between a pair of base and retainer strips.

7. A machine according to claim 1 wherein said receptacle tines are displaced transversely relative to said conveyor tines to permit each conveyor tine to pass between a pair of receptacle tines thus causing articles carried by said conveyor to be combed out of said conveyor tines.

8. A machine according to claim 1 wherein said receptacle tines are disposed on a transverse rod and perpendicular to a bottom flight of said conveyor, said conveyor tines transverse arcuate paths at an upper rear end of said conveyor and then cooperate with said receptacle tines as they pass therebetween to cause articles carried by said conveyor to dislodge and be discharged into said receptacle.

9. A machine according to claim 1 wherein said conveyor is perforated to allow ground particles deposited on said conveyor to gravity fall therethrough.

10. A machine according to claim 1 wherein said conveyor is of a chain link construction.

11. A machine according to claim 1 wherein said conveyor includes a flight at a lower, front end thereof, spaced from and disposed substantially parallel to ground level.

12. A machine according to claim 1 including at least one idler wheel mounted on said support frame and operatively engaging an underside flight of said conveyor.

13. A machine according to claim 1 wherein said receptacle is pivotal about a transverse axis.

14. A machine according to claim 1 wherein said receptacle is tiltable about a transverse axis passing therethrough.

15. A machine according to claim 1 including a transversely disposed shaft mounted on said support frame and wherein said receptacle includes a pair of lift arms pivotally connected to said shaft, and at least one fluid actuated cylinder assembly operatively interconnecting said support frame and one of said lift arms.

16. A machine according to claim 1 including a transversely disposed shaft journaled in said support frame having a sprocket with a radially disposed arm, a pair of trunnions mounted on side walls of said receptacle, at least one sprocket rigidly mounted on one of said trunions, an endless chain trained around said sprockets for transmitting rotary motion therebetween, and a fluid actuated cylinder assembly interconnecting said support frame and said radially disposed arm operative to pivot said arm and correspondingly tilting said receptacle.

17. A machine according to claim 15 including a sprocket provided with a radially disposed arm mounted on said shaft, a sprocket rigidly mounted on said receptacle coaxially with a pivotal connection of said arms to said receptacle and pivotal about said axis, an endless chain trained about said sprockets for transmitting rotary motion therebetween and a fluid actuated assembly interconnecting said support frame and said radially disposed arm operative to pivot said arm and correspondingly tilting said receptacle.

18. A machine according to claim 1 wherein said conveyor driving means includes a hydraulic motor.

19. A machine according to claim 1 including a pair of side walls mounted on said support frame and wherein said conveyor is disposed therebetween.

20. A machine according to claim 2 wherein the angular relationship of said support frame in said drawbar may be varied to correspondingly vary the position of said tines relative to the ground.

* * * * *